US006615418B2

(12) United States Patent
Minami

(10) Patent No.: US 6,615,418 B2
(45) Date of Patent: Sep. 9, 2003

(54) AUTOMATIC HAIR WASHER

(75) Inventor: Nobuyuki Minami, Osaka (JP)

(73) Assignee: Oohiro Works, Ltd. (JP)

( * ) Notice: Subject to any disclaimer, the term of this patent is extended or adjusted under 35 U.S.C. 154(b) by 0 days.

(21) Appl. No.: 09/968,231

(22) Filed: Oct. 1, 2001

(65) Prior Publication Data

US 2002/0184703 A1 Dec. 12, 2002

(30) Foreign Application Priority Data

Jun. 11, 2001 (JP) ..... P.A.2001-176192

(51) Int. Cl.[7] ..... A45D 19/00
(52) U.S. Cl. ..... 4/515; 4/519
(58) Field of Search ..... 4/515–523

(56) References Cited

U.S. PATENT DOCUMENTS 1,605,623 A * 11/1926 Smith ..... 4/525
2,682,058 A * 6/1954 Wolfe ..... 4/516
5,906,012 A * 5/1999 Sakane et al. ..... 4/519

FOREIGN PATENT DOCUMENTS

JP 1117268 6/2001

OTHER PUBLICATIONS

U.S. Ser. No. 29/124,731, Minami, filed Jun. 9, 2000.

* cited by examiner

*Primary Examiner*—Charles E. Phillips
(74) *Attorney, Agent, or Firm*—Wall Marjama & Bilinski LLP

(57) ABSTRACT

The present invention provides an automatic hair washer with which a person who operates the hair washer can perform finish washing, supplementary washing or the like easily after hair washing by the automatic hair washer. A large oblique section is formed on the corner of the front of a cabinet 9 by which the exterior of the automatic hair washer is formed. Thereby, a work area 10 for the person who operates the hair washer is provided, and further, a space 11 into which the person who operates the hair washer can put his foot is provided on the lower part of the large oblique section.

1 Claim, 5 Drawing Sheets

AUTOMATIC HAIR WASHER

FIELD OF THE INVENTION

The present invention relates to an automatic hair washer which washes the hair of a person and, more particularly, to an automatic hair washer with which a person who operates the hair washer can work easily for a person whose hair is to be washed.

BACKGROUND OF THE INVENTION

In a prior art automatic hair washer, after the automatic hair washing by spouting hot water toward the hair of a person whose hair is to be washed, a person who operates the automatic hair washer performs supplementary work such as supplementary washing, finish washing or the like which can not be performed by the automatic hair washer, by using a hand shower which is provided with the automatic hair washer.

Hereinafter, the operation of the prior art automatic hair washer will be described with reference to FIGS. 4 and 5. FIG. 4 is a perspective view illustrating a prior art automatic hair washer. FIG. 5 is a top view illustrating the prior art automatic hair washer.

In the prior art automatic hair washer 40, as shown in FIGS. 4 and 5, its exterior is formed by a cabinet 9, and a hood 2 for covering around the face of a person whose hair is to be washed is attached to the center of the upper surface of the cabinet 9 so as to be opened and closed freely. Besides, a cistern 1 having a plurality of nozzles for spouting hot water is disposed inside the hood 2. In performing the hair washing, the hood 2 is opened, and the head of the person whose hair is to be washed is inserted such that his hair hangs down into the cistern 1 in the posture of lying on his head.

Besides, on the left side of the upper surface of the cabinet 9, a hand shower 3 which the person who operates the automatic hair washer 40 uses for a finish of the hair washing, or the like is provided drawably. Knobs 5 and 4 for flowing/stopping cold or hot water spouted from the hand shower 3 and controlling a flow of the cold or hot water are positioned on the right side of the upper surface of the cabinet 9. Further, a hollow is formed on the left side of the far side of the upper surface of the cabinet 9, and a shampoo vessel 7 in which shampoo agent is stored and a rinse vessel 8 in which rinse agent is stored are equipped removably on the hollow.

In addition, for example, on the right side of the upper surface of the cabinet 9, an operation panel 6 is disposed, and various kinds of key switches for inputting operation signals to a control (not shown) are arranged on the operation panel 6.

When the hair washing is performed by the prior art automatic hair washer 40 having a structure as described above, the person who operates the hair washer, first, opens the hood 2 of the automatic hair washer 40 and closes it so that it covers the top of the cistern 1 except for the face portion of the person whose hair is to be washed, after leading the person whose hair is to be washed to lie on his back on a chair for hair washing so that his head is put in the cistern 1 of the automatic hair washer 40 as shown in FIG. 6. Thereafter, the person who operates the hair washer pushes a hair washing start switch or the like on the operation panel 6 to start the hair washing by the automatic hair washer 40.

After the hair washing by the above-described automatic hair washer 40, the person who operates the hair washer uses the hand shower 3 disposed on the left side of the upper surface of the cabinet 9 to perform the finish washing, the supplementary washing or the like for the hair of the person under hair washing. In performing the work like this, the person who operates the hair washer stands on a work area 50 in FIG. 5, and pulls the hand shower 3 out of the cabinet 9. Then, he performs the finish washing, the supplementary washing or the like, after controlling temperature of the hot water spouted from the hand shower 3 by turning knobs 4 and 5.

However, in the prior art device, since a standing position where the person who operates the hair washer stands in the finish washing, the supplementary washing or the like, i.e., the work area 50 is apart from the cistern 1, the distance between the head of the person under hair washing and the person who operates the hair washer becomes long. Thereby, the person who operates the hair washer keeps an unnatural posture during the work as described above, as a result, a heavy burden is put on him during the work.

SUMMARY OF THE INVENTION

Present invention is made to solve the above-described problems and has its object to provide an automatic hair washer with which the person who operates the hair washer can work easily in performing the finish washing, the supplementary washing or the like after the hair washing by the automatic hair washer.

Other objects and advantages of the present invention will become apparent from the detailed description and specific embodiments described are provided only for illustration since various additions and modifications within the spirit and scope of the invention will be apparent to those of skill in the art from the detailed description.

According to a first aspect of the present invention, an automatic hair washer, whose exterior is formed by a cabinet, comprises a cistern having a plurality of nozzles for spouting wash water, and washes the hair of a person whose hair is to be washed automatically with the wash water spouted from the plural nozzles. Further, in this automatic hair washer, a large oblique section is formed on the corner of the cabinet, and a hollow into which the person who performs the supplementary work of the automatic hair washer can put his foot is provided on the lower part of the oblique section.

DETAILED DESCRIPTION OF THE PREFERRED EMBODIMENTS

[Embodiment 1]

Hereinafter, an automatic hair washer according to a first embodiment will be described.

Figure 1:
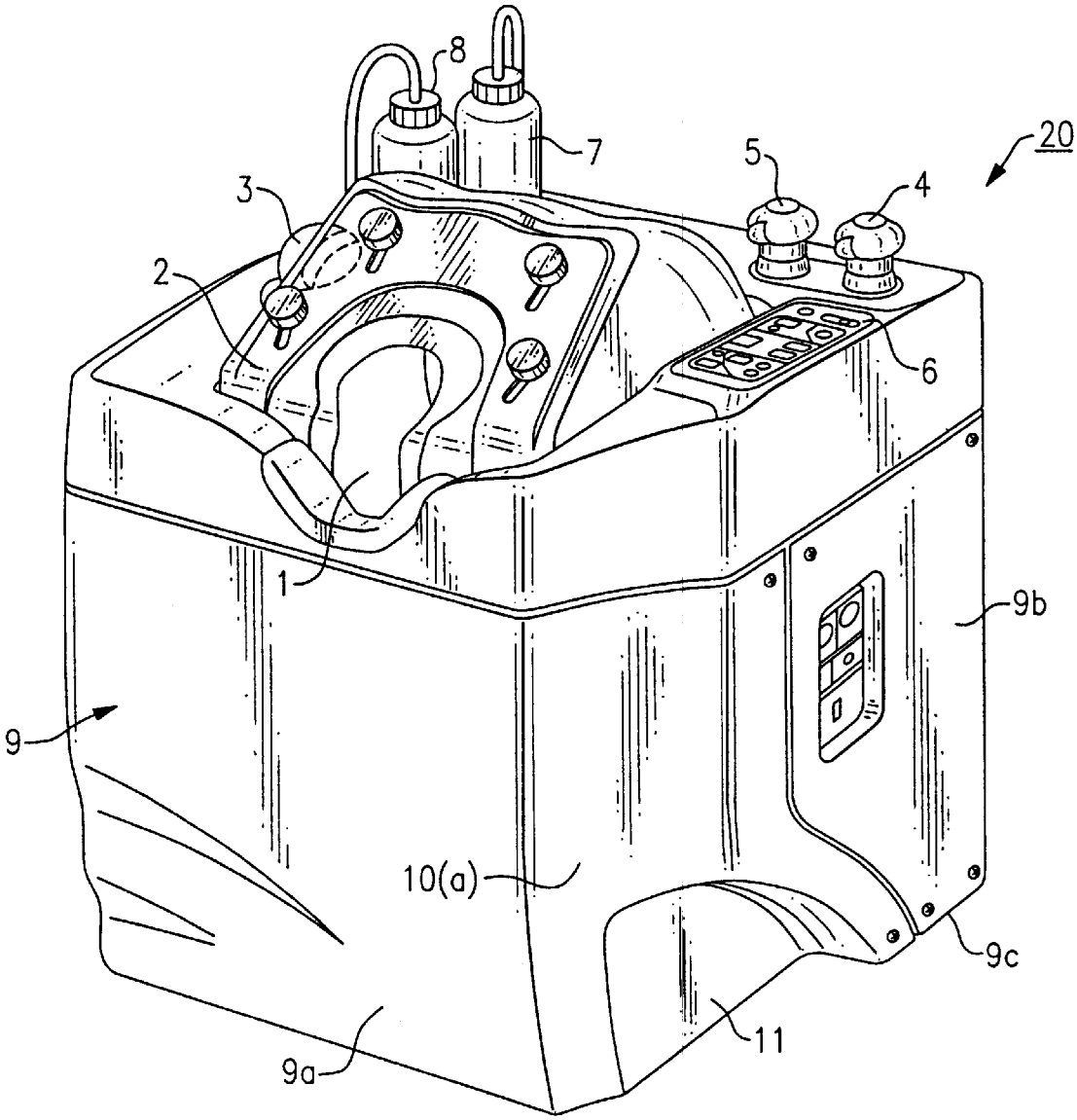
FIG. 1 is a perspective view of an automatic hair washer according to a first embodiment of the present invention.
Figure 2:
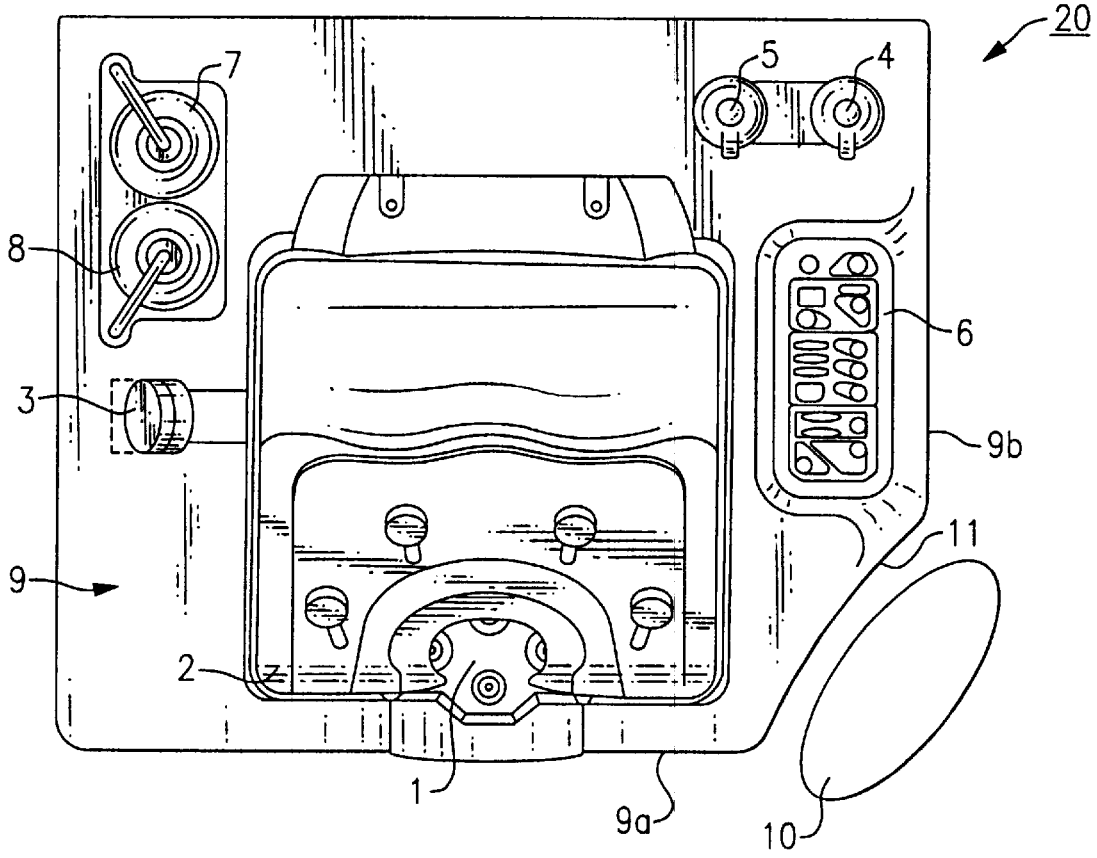
FIG. 2 is a top view of the automatic hair washer according to the first embodiment of the present invention.

Initially, a structure of the automatic hair washer according to the first embodiment will be described with reference to FIGS. 1 and 2. FIG. 1 is a perspective view of the automatic hair washer according to the first embodiment. FIG. 2 is a top view of the automatic hair washer according to the first embodiment.

Figure 4:
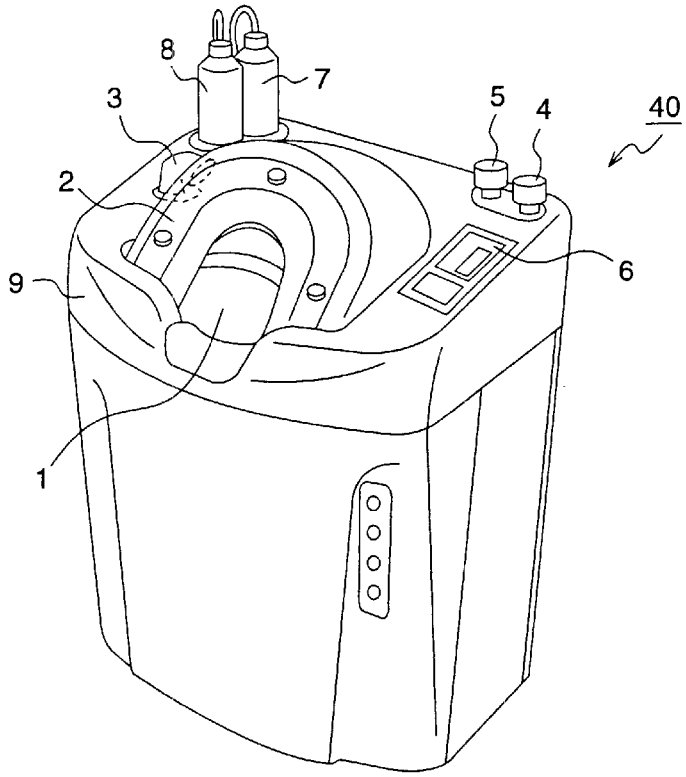
Fig.4 Prior Art
FIG. 4 is a perspective view of a prior art automatic hair washer.
Figure 5:
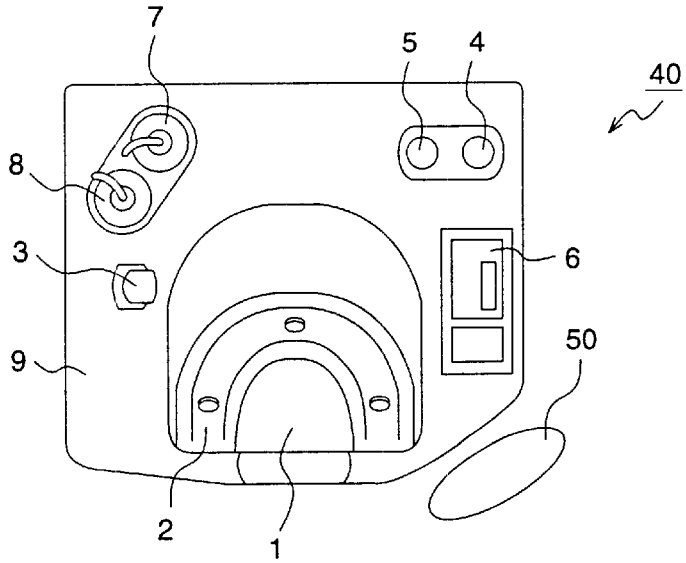
Fig.5 Prior Art
FIG. 5 is a top view of the prior art automatic hair washer.
Figure 6:
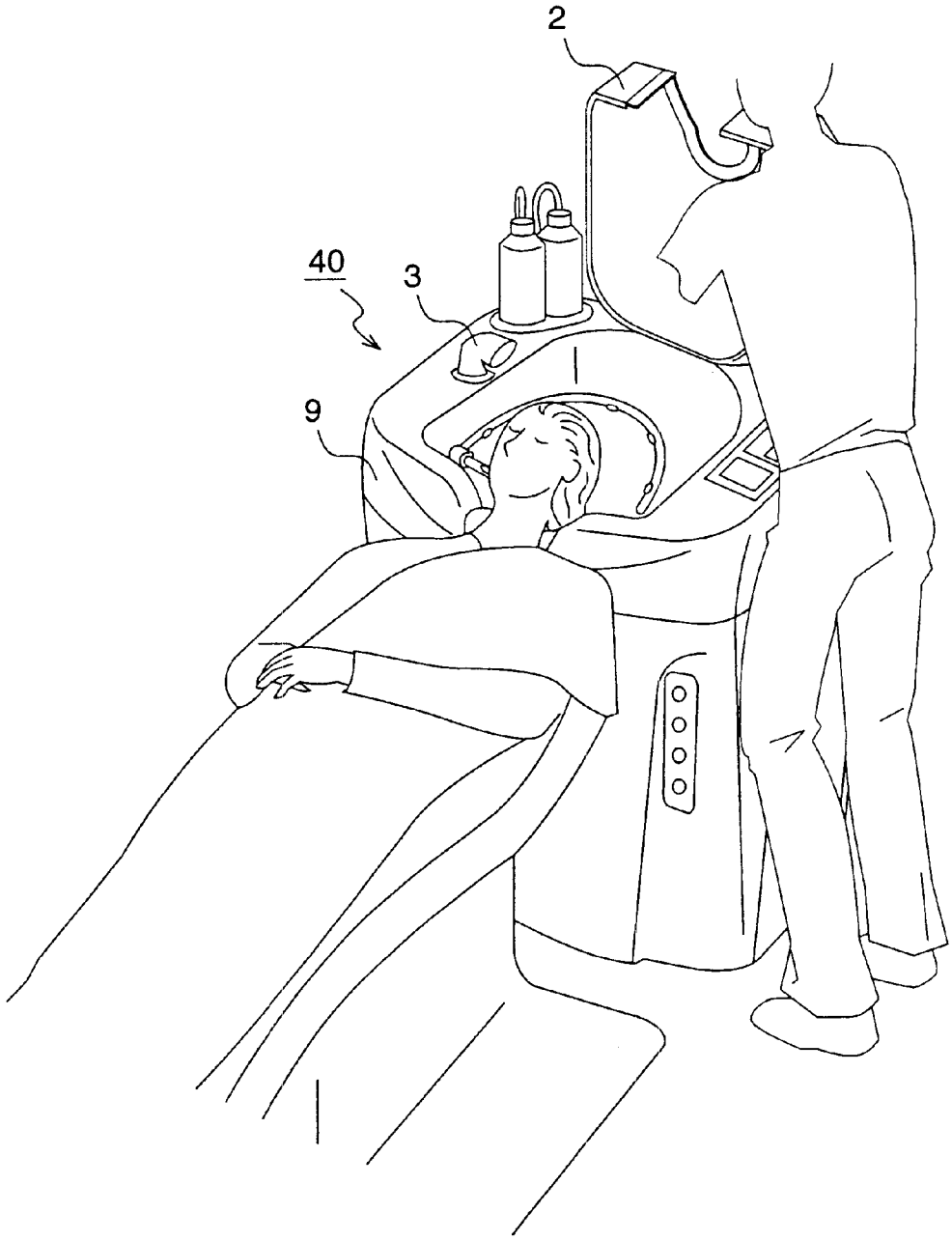
Fig.6 Prior Art
FIG. 6 is a diagram illustrating a situation of the prior art automatic hair washers in use.

With reference to FIGS. 1 and 2, in the automatic hair washer 20 according to the first embodiment, a large oblique chamfered recess 10*a* is formed on the corner of a cabinet 9 between front wall 9*a* and side wall 9*b* by which the exterior of the automatic hair washer is formed. The cabinet contains a bottom wall 9*c* for resting the cabinet upon a substrate. Thereby, a work area 10 wherein a person who operates the hair washer performs supplementary work of the automatic hair washer 20 and an indentation 11 that extends upwardly from the bottom wall 9*c* into the recess and a portion of the side wall 9*b* into which the person who operates the hair washer can place his or her feet is provided. In FIGS. 1 and 2, the same reference numerals as those in FIGS. 4 and 4 denotes the same or corresponding parts.

Figure 3:
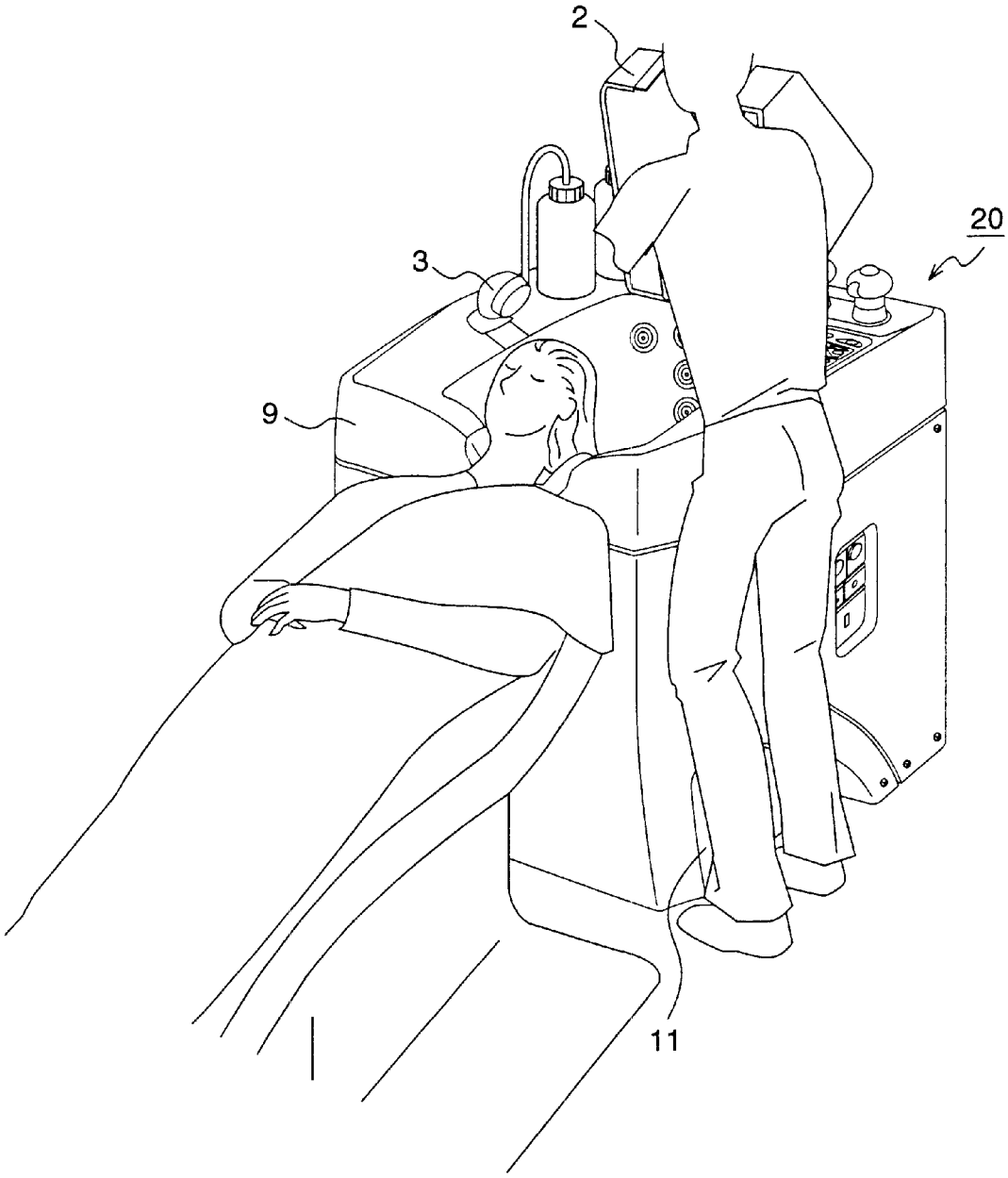
FIG. 3 is a diagram illustrating a situation of the automatic hair washer according to the first embodiment of the present invention in use.

When hair washing is performed by the automatic hair washer 20 according to the first embodiment having a structure as described above, the person who operates the hair washer, first, stands on the work area 10 in FIG. 2, and opens a hood 2 of the automatic hair washer 20. Next, he leads a person whose hair is to be washed to sit on a chair for hair washing positioned in front of the automatic hair washer 20, and tilts the chair over as shown in FIG. 3 to set the head of the person whose hair is to be washed in a cistern 1 of the automatic hair washer 20. Then, the person who operates the hair washer closes the hood 2 such that it covers the upper side of the cistern 1 except for the face portion of the person whose hair is to be washed. During this work, the person who operates the hair washer can perform the work in his natural posture because he can put his foot into a space 11 deeply. Thereafter, he pushes a hair washing start switch or the like on an operation panel 6 to start the hair washing by the automatic hair washer 20.

After the automatic hair washer 20 finishes the hair washing, the person who operates the hair washer uses a hand shower 3 positioned on the left side of the upper surface of the cabinet 9 to perform finish washing, supplementary washing or the like for the hair of the person under hair washing. During this work, the person who operates the hair washer stands on the work area 10 in FIG. 2, and pulls the hand shower 3 out of the cabinet 9. Then, he performs the finish washing, the supplementary washing or the like for the hair of the person under hair washing after controlling temperature of hot water spouted from the hand shower 3 by turning knobs 4 and 5.

During this work, since the person who operates the hair washer can perform the work putting his tiptoe into the space 11 deeply, he can get closer to the person under hair washing and keep his natural posture, as a result, he can perform this work easily. In addition, even if it takes a long time to complete the finish washing, supplementary washing or the like, he can keep his natural posture during this work. Therefore, he can continue to work without feeling fatigue.

In this way, according to the first embodiment, the large oblique section is formed on the corner of the cabinet 9 by which the exterior of the automatic hair washer is formed, and the space 11 into which the person who operates the hair washer can put his foot is provided on the lower part of the oblique section. Therefore, when the person who operates the hair washer performs the supplementary work, for example, the finish washing, the supplementary washing or the like for the person under hair washing by using the hand shower 3 or the like, he can get closer to the person under hair washing, and can perform this work easily in his natural standing posture. Thereby, a burden which the person who operates the hair washer is loaded during this work can be lightened. In addition, even if it takes a long time to complete the supplementary work, he can continue to perform this work without feeling fatigue.

As described above, according to the first aspect of the present invention, the automatic hair washer, whose exterior is formed by the cabinet, comprises the cistern having a plurality of nozzles for spouting wash water, and washes the hair of the person whose hair is to be washed automatically with the wash water spouted form the plural nozzles. Further, in this automatic hair washer, the large oblique section is formed on the corner of the cabinet, and a hollow into which the person who performs the supplementary work of the automatic hair washer can put his foot is provided. Therefore, he can performs the supplementary work such as the finish washing, the supplementary washing or the like in his natural standing posture, as a result, a burden which the person who operates the hair washer is loaded during this work can be lightened. In addition, even if it takes a long time to complete the supplementary work, he can continue to perform this work without feeling fatigue.

What is claimed is:

1. Apparatus for allowing an operator to more efficiently wash a persons hair wherein said apparatus includes:

a cabinet having a top wall and a cistern mounted in said top wall adjacent to a front wall of the cabinet whereby a person's head can be easily received in said cistern during a hair washing operation and a bottom wall for resting the cabinet upon a substrate;

a chamfered recess formed in a corner of said cabinet between said front wall and one side wall, said recess extending from the top wall of the cabinet downwardly to said bottom wall of said cabinet so that an operator can stand within said recess; and a hollow indentation passing upwardly from said bottom wall into the chamfered recess and a lower section of said one side wall of said cabinet so that one or both of the operators feet can be received in said indentation when the operator is standing in said recess facing either the cistern or the rear of the cabinet.

* * * * *